US005669514A

United States Patent [19]

Massetti

[11] Patent Number: 5,669,514

[45] Date of Patent: Sep. 23, 1997

[54] GOLF CLUB HOLDER

[76] Inventor: Joseph Massetti, 132 Radigan Ave., Staten Island, N.Y. 10309

[21] Appl. No.: 655,745

[22] Filed: May 30, 1996

[51] Int. Cl.[6] ..... A47F 7/00

[52] U.S. Cl. ..... 211/70.2

[58] Field of Search ..... 211/70.2, 60.1, 211/68; 273/317.2, 108.2, 245; 206/579, 315.2; 248/530, 156

[56] References Cited

U.S. PATENT DOCUMENTS 3,966,051 6/1976 Hollister et al. ..... 211/70.2 X 5,072,539 12/1991 Greenberg ..... 211/70.2 X 5,417,334 5/1995 Wu ..... 211/70.2

5,474,191 12/1995 Bergeron et al. ..... 211/70.2

*Primary Examiner*—Alvin C. Chin-Shue

*Assistant Examiner*—Sarah L. Purol

*Attorney, Agent, or Firm*—Ira M. Adler, Esq.

[57] ABSTRACT

A compact holder for golf clubs which can be easily taken apart and stored in a player's pocket when not in use. When used by the player, the golf clubs are firmly held by the holder and can be used in a standing up position with the golf club heads resting on the ground or with a spike into the ground.

4 Claims, 3 Drawing Sheets

GOLF CLUB HOLDER

FIELD OF THE INVENTION

The present invention relates to a compact holder for golf clubs which can be easily taken apart and stored in a player's pocket when not in use. When used by the player, the golf clubs are firmly held by the holder and can be used in a standing up position with the golf club heads resting on the ground or with a spike into the ground.

BACKGROUND OF THE INVENTION

Previously when a golfer took their clubs to a practice range, they would have to take their bags, which is heavy and easily stolen. Prior inventions aimed at avoidance golf bags, such as Wu, U.S. Pat. No. 5,417,334 and Reach U.S. Pat. No. 1,661,500 required cumbersome straps to hold golf clubs in place. Other patents, such as Smith, U.S. Pat. No. 2,024,484, as well as the latter two cited, can not be easily disassembled.

OBJECTS OF THE INVENTION

It is an object of the present invention, therefore, to provide a golf club holder which can be easily disassembled and transportable.

It is another object of the invention to provide a golf club holder which can be stood up for ease of access of the golf clubs.

SUMMARY OF THE INVENTION

As will become clear from the following description, the herein golf club holder provides for easy disassembly and secure storage of golf clubs.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
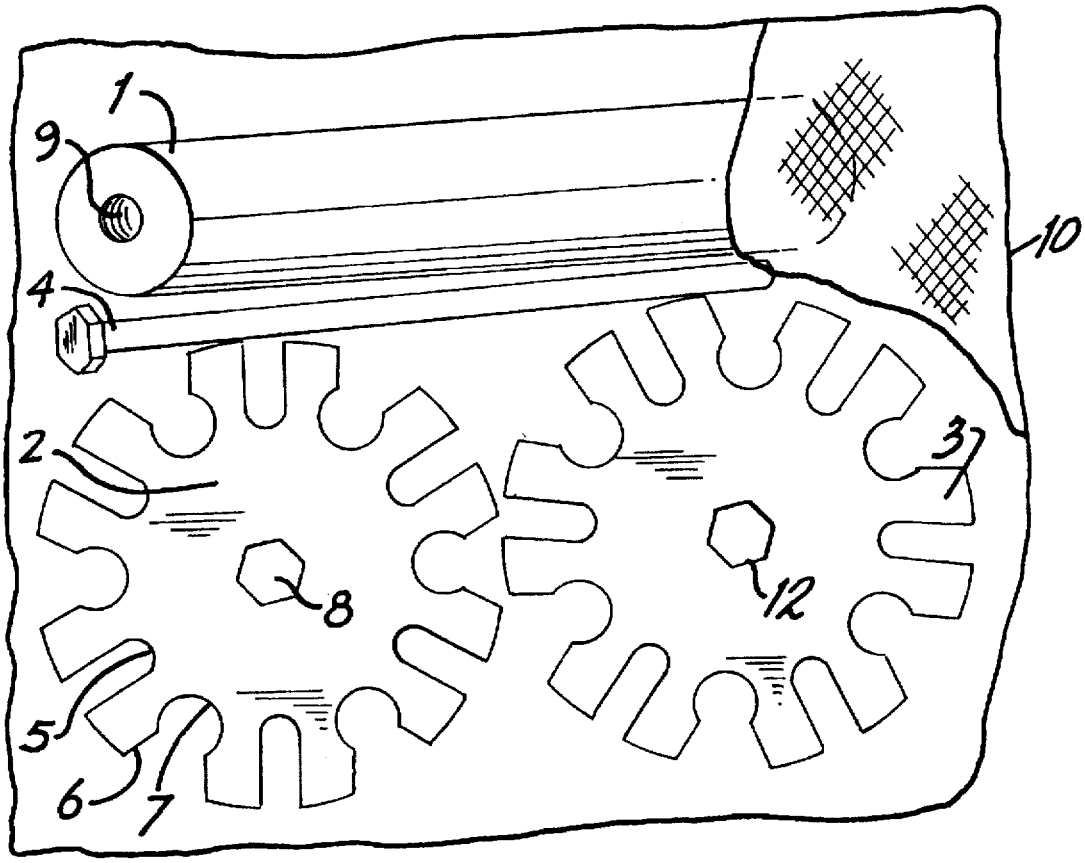
FIG. 1 is a view of the invention disassembled and inserted in a container or pocket.

Referring to the drawings, the invention is seen in FIG. 1 in a disassembled state and consists of a top holder plate, 2, a bottom holder plate, 3, a tubular separator, 1, having a hollow cylindrical hole running lengthwise, 9. A connector bolt, 4, holds the parts together. In this state, the golfer can hold the parts in a pocket or container, 10.

As further seen in FIG. 1, the top holder plate, 2, and the bottom holder plates, 3, consist of a disk shaped member, with a plurality of cutouts around its periphery. These cutouts alternate between a "U" shaped cutout, 5, and a club holder cutout, 7. The top and bottom holders, which may be made of nylon or plastic, as configured will result in lateral force being exerted on both sides of the club cutout. This cause the golf clubs to be firmly held in the holder.

Figure 2:
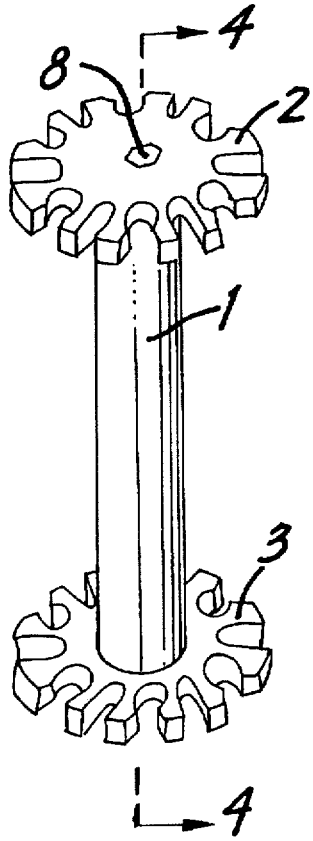
FIG. 2 is a perspective view of the invention.
Figure 3:
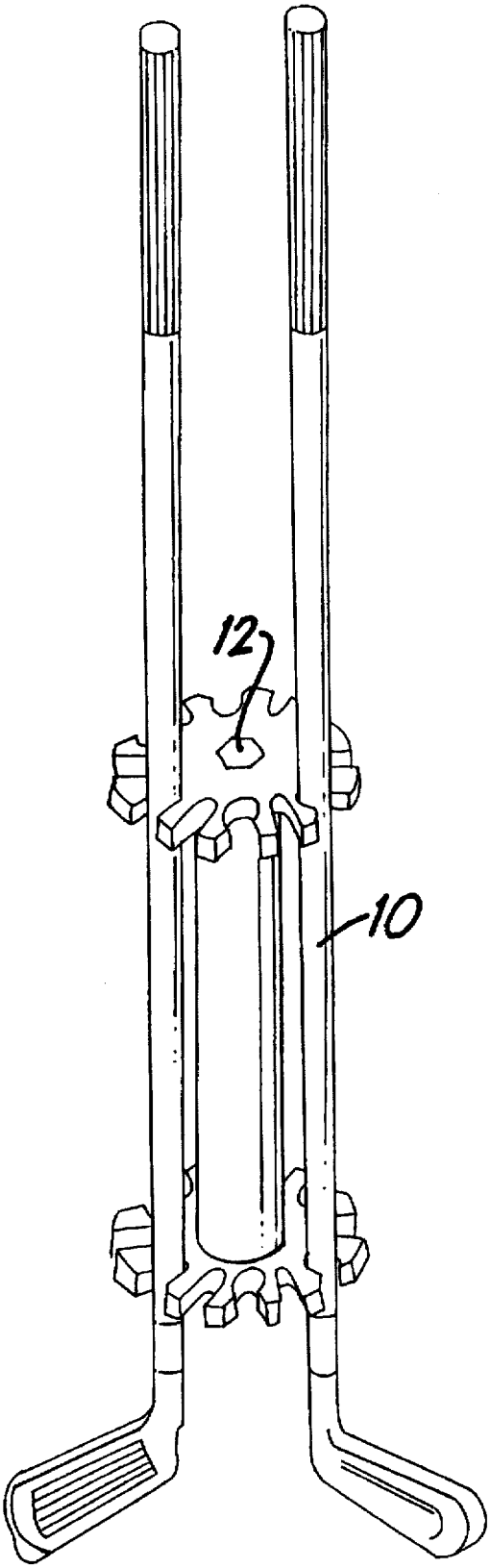
FIG. 3 is a perspective view of the invention showing golf clubs being held.
Figure 4:
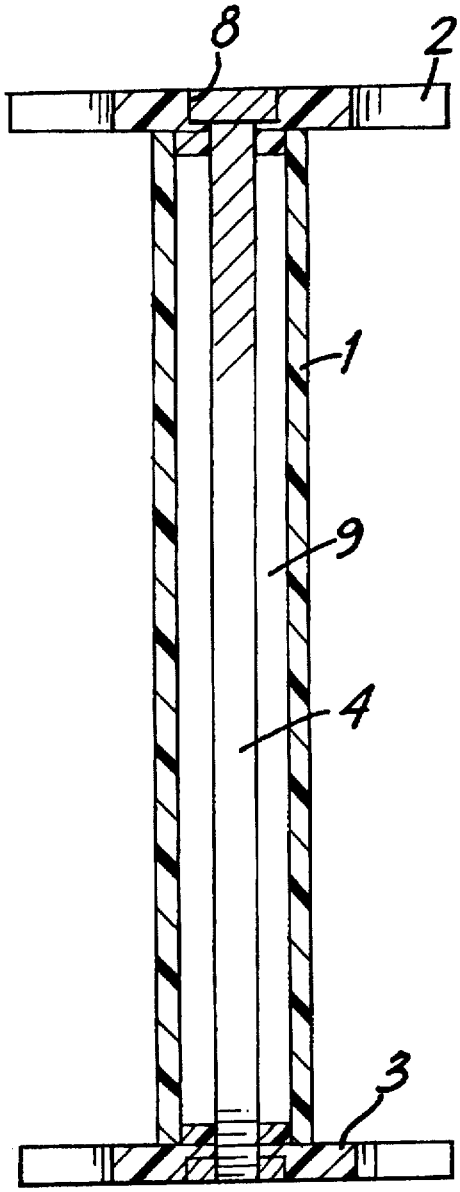
FIG. 4 is a cross section of FIG. 2

The holder is shown assembled in FIGS. 2 AND 3. The latter shows golf clubs, 10, being stored in the holder. In the embodiment of the invention a connector bolt, 4, is inserted into a hole, 8, which is partially cut into the top surface of the top holder plate, 2. The bolt shaft passes lengthwise hole through the central axis, 9, of the tubular separator, 1. The bolt passes through a hole in the bottom holder plate, 3. The assembly is locked in place with a lower nut, 11, as seen in FIG. 4.

Figure 5:
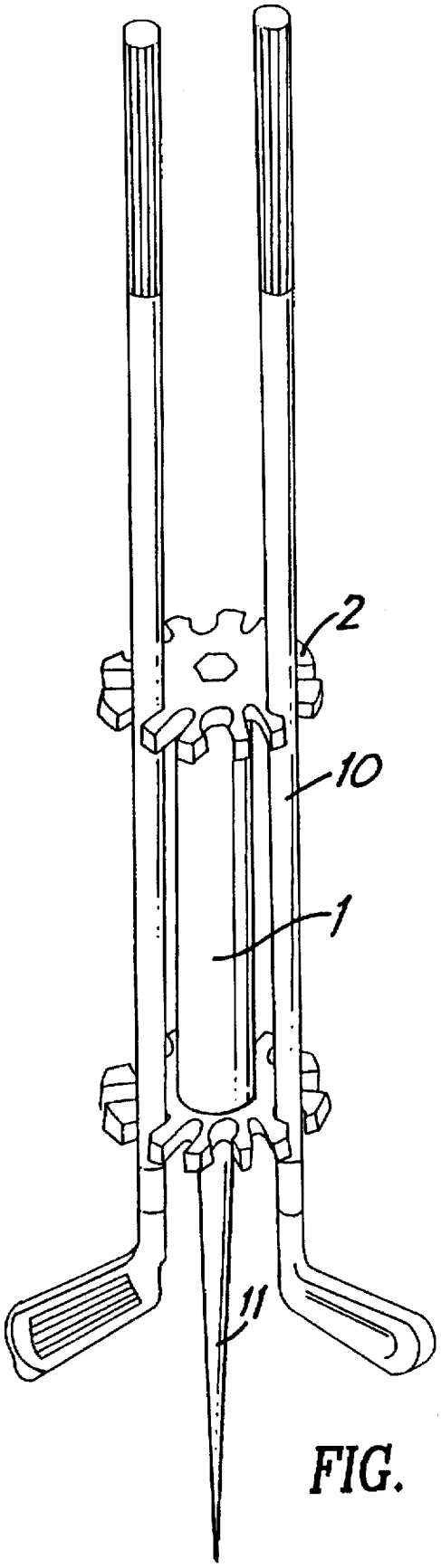
FIG. 5 is a perspective view of the invention, with a bottom spike being seen.

In another embodiment of the invention, as seen in FIG. 5, the bolt has a tapered spike, 11, extending from the bolt shaft. The spike can be forced in the ground so that the invention can stand vertically without support of the clubs.

Figure 6:
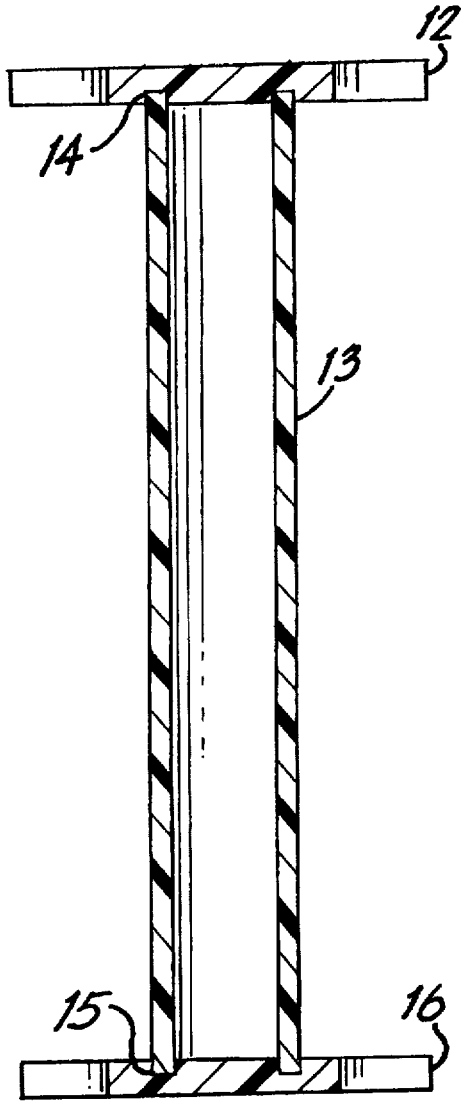
FIG. 6 is a cross section of the invention, with the separator tube press fitted into the top and bottom holder plates.

In another embodiment of the invention, as seen in FIG. 6, a circular groove, 14, is cut centrally into the bottom side of the top holder plate, 12, and a circular groove, 15, is cut into the top side of the bottom holder plate, 16. Both grooves are the same diameter and thickness. A hollow cylindrical separator, 13, having the same diameter as the groove cuts, and approximately the same thickness as the groove cuts, is press fitted into the grooves.

Other options, such as a holding strap, may be added to the invention.

The holder plates and the separator may optionally be made of nylon, hard rubber or plastic.

What I claim is:

1. A golf club holder comprising:

a top holder disc shaped plate having flat top and bottom surfaces, with a partially imbedded hole on the top surface, and a smaller hole going through the remainder of the disc, and having a plurality of alternate radial "U" shaped pressure cutouts and golf club holder cutouts which are substantially circular with a flared outward opening;

a bottom holder disc shaped plate having flat top and bottom surfaces, with a partially imbedded hole on the bottom surface, and a smaller hole going through the remainder of the disc, and having a plurality of alternate radial "U" shaped pressure cutouts and golf club holder cutouts which are substantially circular with a flared outward opening;

a tubular separator having a lengthwise hole passing through its central axis;

a lower nut;

a connector bolt, having a central cylinder, with a flat head at the top and threads at the bottom, with the flat head passing through the partially imbedded hole in the top surface of the top holder plate, the central cylinder passing through the smaller hole in the disc, the lengthwise hole in the tubular separator, the smaller hole of the bottom holder and the thread portion secured by the lower nut, which is inside the imbedded hole of bottom holder.

2. The golf club holder in claim 1, wherein the top holder plate, the bottom holder plate, the tubular separator, the connector bolt and the lower nut are disassembled, but held in a container means.

3. The golf club holder in claim 1, wherein the connector bolt has a spike-like extension extending from the bottom of the bottom holder plate, such that the spike can be forced in the ground.

4. A golf club holder comprising:

a top holder disc shaped plate having flat top and bottom surfaces, having a circular groove cut centrally into the bottom side of said top holder disc, and having a plurality of alternate radial "U" shaped pressure cutouts and golf club holder cutouts which are substantially circular with a flared outward opening;

a bottom holder disc shaped plate having flat top and bottom surfaces, having a circular groove cut centrally into the top side of said bottom holder disc, being the same diameter as the grooves cut in the top holder disc, and having a plurality of alternate radial "U" shaped pressure cutouts and golf club holder cutouts which are substantially circular with a flared outward opening;

a tubular separator having the same diameter as the grooves in the top and bottom holder discs and substantially the same thickness as the grooves, said separator being fitted into the grooves.

* * * * *